US006003480A

United States Patent [19]

Quayle et al.

[11] Patent Number: 6,003,480

[45] Date of Patent: Dec. 21, 1999

[54] WOBBLE PLATE ENGINE

[75] Inventors: Noel Quayle; Cornelis Koppenol, both of Qld, Australia

[73] Assignee: Q-Tre Pty Ltd, Australia

[21] Appl. No.: 09/068,907

[22] PCT Filed: Nov. 20, 1996

[86] PCT No.: PCT/AU96/00735

§ 371 Date: May 20, 1998

§ 102(e) Date: May 20, 1998

[87] PCT Pub. No.: WO97/19254

PCT Pub. Date: May 29, 1997

[30] Foreign Application Priority Data

Nov. 20, 1995 [AU] Australia ..... PN6643

[51] Int. Cl.[6] ..... F02B 75/26

[52] U.S. Cl. ..... 123/56.1; 123/56.3; 123/56.6

[58] Field of Search ..... 123/56.1, 56.3, 123/56.6

[56] References Cited

U.S. PATENT DOCUMENTS

| | | | |
|---|---|---|---|
| 1,978,194 | 10/1934 | Gray | 123/41.74 |
| 2,551,025 | 5/1951 | Lindeman, Jr. | 74/60 |
| 4,622,927 | 11/1986 | Wenker | 123/51 B |
| 5,027,756 | 7/1991 | Shaffer | 123/56.5 |
| 5,080,561 | 1/1992 | Tanguchi | 417/222.2 |
| 5,094,195 | 3/1992 | Gonzalez | 123/56.4 |
| 5,564,372 | 10/1996 | Llewellyn | 123/56.3 |
| 5,709,176 | 1/1998 | Llewellyn | 123/56.3 |

FOREIGN PATENT DOCUMENTS

| | | | |
|---|---|---|---|
| 7495/22 | of 1923 | Australia . | |
| 58766/90 | 1/1991 | Australia . | |
| 001080605 | 12/1954 | France | 123/56.6 |
| 3711205 A1 | 10/1988 | Germany . | |
| 70194 | 1/1915 | Switzerland | 123/56.6 |
| 2101226 | 1/1983 | United Kingdom . | |

*Primary Examiner*—Henry C. Yuen
*Assistant Examiner*—Hai Huynh
*Attorney, Agent, or Firm*—Cantor Colburn LLP

[57] ABSTRACT

A wobble plate engine assembly incorporating as offset mount between the wobble plate and each connecting rod to a piston such that a line of action of the connecting rod at the wobble plate is resolved into a centripetal and tangential component thereby minimizing the component of applied forced directed through the wobble plate and maximizing the force the force applied along the wobble plate. The connections between the wobble plate, connecting rod and pistons incorporate spherical bearings. Also a wobble plate internal combustion engine incorporating the wobble plate engine assembly is presented.

17 Claims, 7 Drawing Sheets

WOBBLE PLATE ENGINE

FIELD OF THE INVENTION

This invention relates to internal combustion engines of the type that employ a swash or wobble plate to transfer power from parallel pistons to a central shaft.

BACKGROUND TO THE INVENTION

Wobble plate engines have been known for many years. Early engines of this type comprised a number of parallel pistons disposed about a central driven shaft. Lateral displacement of the pistons is transformed to rotational motion of the shaft by a wobble or smash plate fixed at an angle on the shaft. Reciprocation of the piston causes a tangential displacement of the wobble plate thereby rotating the shaft.

Australian Patent number 14759/23 in the name of Crankless Engines (Aus.) Pty Ltd describes a dual swash-plate engine wherein the swash-plates are driven by double ended pistons sharing a common combustion chamber. This engine, and other engines developed by Crankless Engines (Aus.) Pty Ltd where incorporated in motor vehicles.

Although wobble plate engines have been known for 70 years they have not been generally accepted as internal combustion engines. The use has been limited to hydraulic pumps and other driven devices as opposed to driving devices. Various attempts have been made to improve or modify the basic wobble plate design for use in internal combustion engines.

Australian Patent Application number 41322/85 in the name of S.V. Engine Co. Pty Ltd described a number of improvements that could be made to the design of a wobble plate engine. These included a damping system for stabilization; a balancing arrangement; a linkage arrangement enabling variation in the tilt of the wobble plate; and improved overall construction features.

Reference may also be made to United Kingdom Patent number 2101226 in the name of Star Motors which describes a high pressure vapour driven engine based on a swash plate. The cylinders are arranged around a central power shaft in conventional manner. The swash-plate is rotatably mounted on the shaft and is connected to the pistons by connecting rods incorporating ball joints at each end. The engine is designed to be driven by high pressure steam derived from geothermal or solar energy.

Despite the many years of development the wobble plate engine has failed to be accepted for internal combustion engine manufacture. This is because of vested interests in cranked engines and because of fundamental design problems. One such design problem is the direct load placed on the wobble plate by the pistons when they fire. The line of action of the pistons is parallel to the axis of rotation of the wobble plate, thus there is a large component of force directed through the wobble plate. Only a portion of the applied force is directed along the wobble plate to force it to rotate. This results in high frictional loads and reduced efficiency of the motor.

OBJECT OF THE INVENTION

It is an object of the present invention to provide a wobble plate engine assembly that overcomes one or more of the above identified problems or at least offers the public a useful alternative to existing internal combustion engines.

DISCLOSURE OF THE INVENTION

In one form, although it need not be the only or indeed the broadest form, the invention resides in a wobble plate engine assembly comprising:

a drive shaft rotatably mounted in a cylinder block;

one or more pistons mounted for reciprocating movement in a respective cylinder in the cylinder block, with the axis of reciprocation of the pistons being substantially parallel to a longitudinal axis of the drive shaft;

a wobble hub associated with the drive shaft for rotation therewith;

a wobble plate rotatably mounted on the wobble hub such that the wobble plate remains rotationally stationary while the drive shaft and wobble hub rotate; and a connecting rod associated with each piston, said connecting rod connecting said piston to a respective offset mount on the wobble plate such that a line of action of the connecting rod at the wobble plate is resolvable into a centripetal and a tangential component.

The line of action of the connecting rod at the offset mount is offset tangentially from a diameter through the wobble plate.

In preference the engine assembly comprises at least four pistons with at least some of the pistons having a line of action of opposite direction to the other pistons thereby maintaining balance.

The wobble hub is preferably formed separate from the drive shaft but keyed to the drive shaft so as to rotate with the drive shaft.

The wobble plate may suitably be rotatably mounted on the wobble hub by a wobble bearing. The wobble bearing may be a thrust or roller bearing.

In preference the offset mount comprises a pair of upstanding lugs. One lug is preferably an extension of a diameter of the wobble plate and the other lug is preferably offset from the first lug along a line parallel to a tangent to the wobble plate diameter.

The connection between the connecting rods and offset mounts preferably incorporate spherical bearings permitting twist and rotation of the connecting rods. The connection between the connecting rods and pistons preferably incorporate similar bearings.

In an alternate form the offset mount comprises a single lug with a spherical bearing attached on opposite sides thereof in cantilever fashion. In this form there is suitably a connecting rod connected to each spherical bearing which connect to oppositely acting pistons.

In a further form the invention resides in an internal combustion engine incorporating a wobble plate engine assembly as herein described with the addition of one or more cylinder heads incorporating a valve assembly.

The internal combustion engine may be four stroke or two stroke, depending primarily on the design of the valve assembly. The engine is preferably four or six cylinder and double ended.

BRIEF DETAILS OF THE DRAWINGS

To assist in understanding the invention preferred embodiments will now be described with reference to the following figures in which.

DETAILED DESCRIPTION OF THE DRAWINGS

Figure 1:
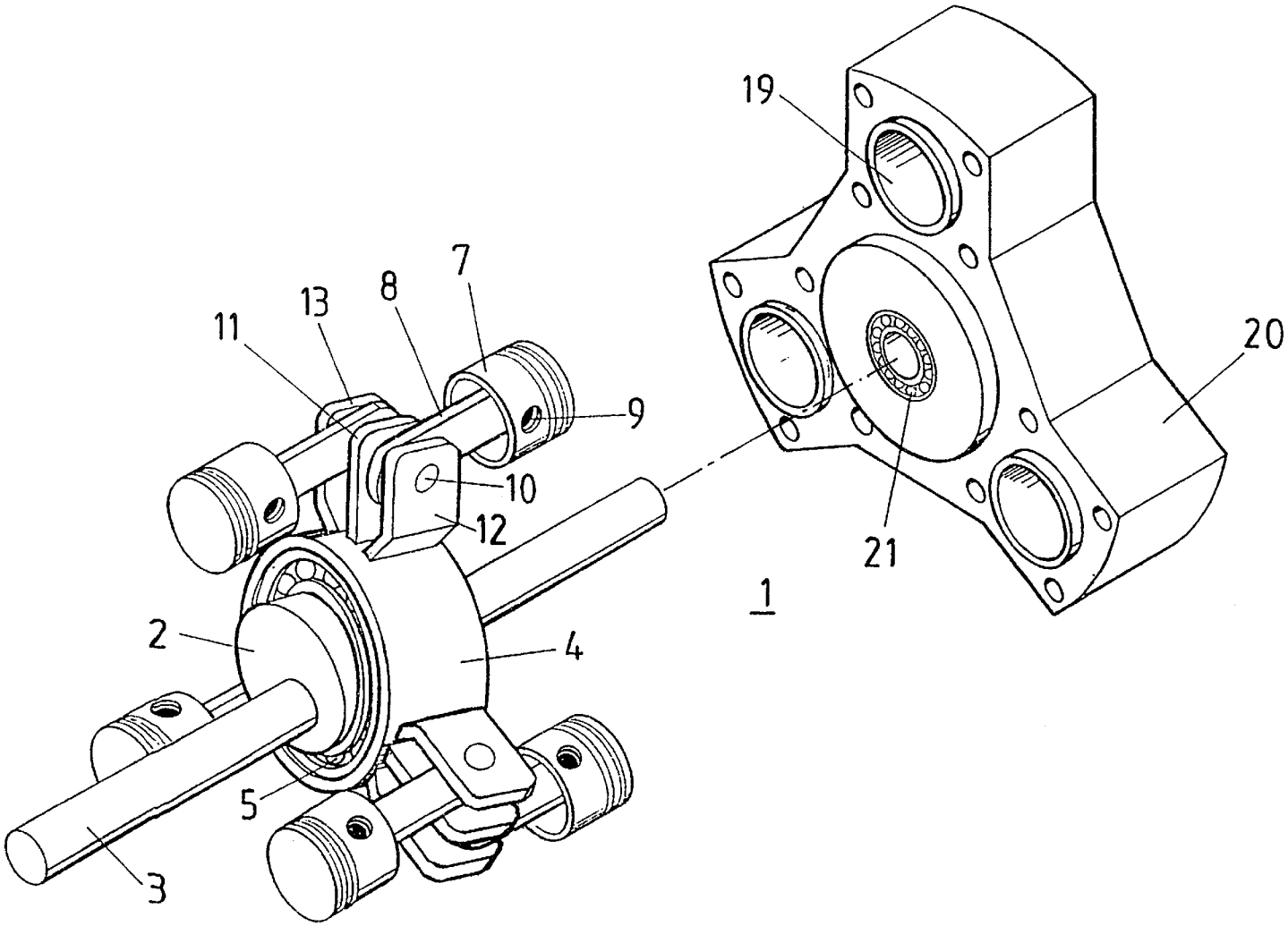
FIG. 1 is a partial exploded view of a six cylinder wobble plate engine.

In the drawings, like reference numerals refer to like parts.

Referring to FIG. 1, there is shown a partial exploded view of a six cylinder wobble plate engine 1. The engine 1 comprises a wobble hub 2 fixed to a central drive shaft 3. A wobble plate 4 is rotationally mounted to wobble hub 2 by wobble bearing 5. The wobble bearing 5 allows for rotational motion of the wobble hub 2 and drive shaft 3 relative to the wobble plate 4.

In the embodiment shown the wobble hub 2 is integrally formed with the drive shaft 3 as a single casting. Alternatively, the wobble hub 2 can be keyed to the drive shaft 3 or fixed by other conventional means.

The wobble plate 4 has a plurality of offset mounts, such as 6, located on the outer perimeter. There is one offset mount per piston 7. Each piston 7 is connected to the offset mount 6 by conrod 8. At one end the piston and conrod are connected by gudgeon pin 9. At the other end, the conrod is connected to offset mount 6 by big end pin 10.

Figure 2:
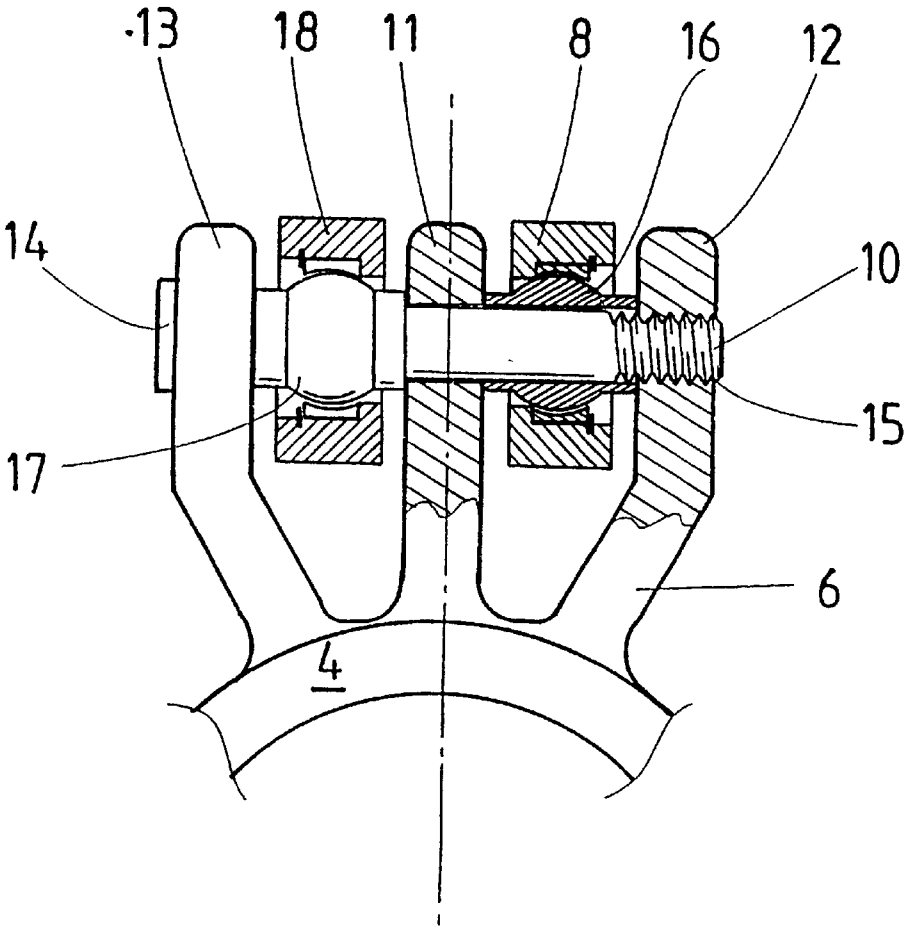
FIG. 2 is an enlarged view of a big-end pin assembly.

The offset mount 6 consists of spaced apart upright lugs. In the embodiment shown two adjacent offset mounts share a common central lug 11. The central lug 11 is an extension of a diameter of the wobble hub. The adjacent offset mounts are formed with the offset lugs 12 and 13 which are displaced along a tangent to the wobble plate. This can be seen more clearly in FIG. 2. The big end pin 10 extends through the lugs 11, 12 and 13. In the particular embodiment shown the pin 10 has a head 14 at one end and a thread 15 at the other end to screw into lug 12. Spherical bearings 16 and 17 are mounted on the big end pin 10. Conrods 8 and 18 are mounted on the spherical bearings 16 and 17 respectively. The spherical bearings permit twist and rotation of the conrods.

The gudgeon pins 9 connecting the pistons 7 to the other end of the conrods, such as 8, have similar spherical bearing assemblies. The pistons 7 reciprocate in cylinders 19 housed in cylinder block 20. For clarity only one half of the cylinder block is shown. The drive shaft 3 is supported in the cylinder block 20 on roller bearing 21.

Figure 3A:
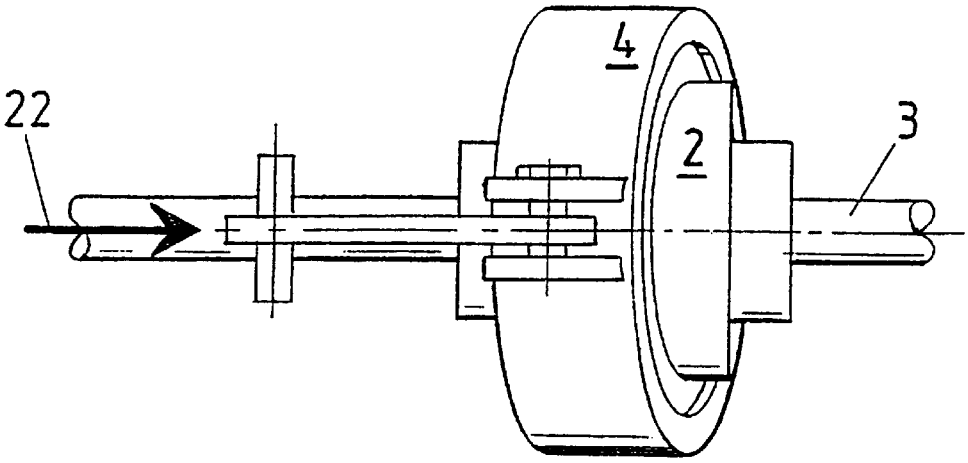
FIG. 3 depicts a prior art wobble plate engine assembly.
Figure 3B:
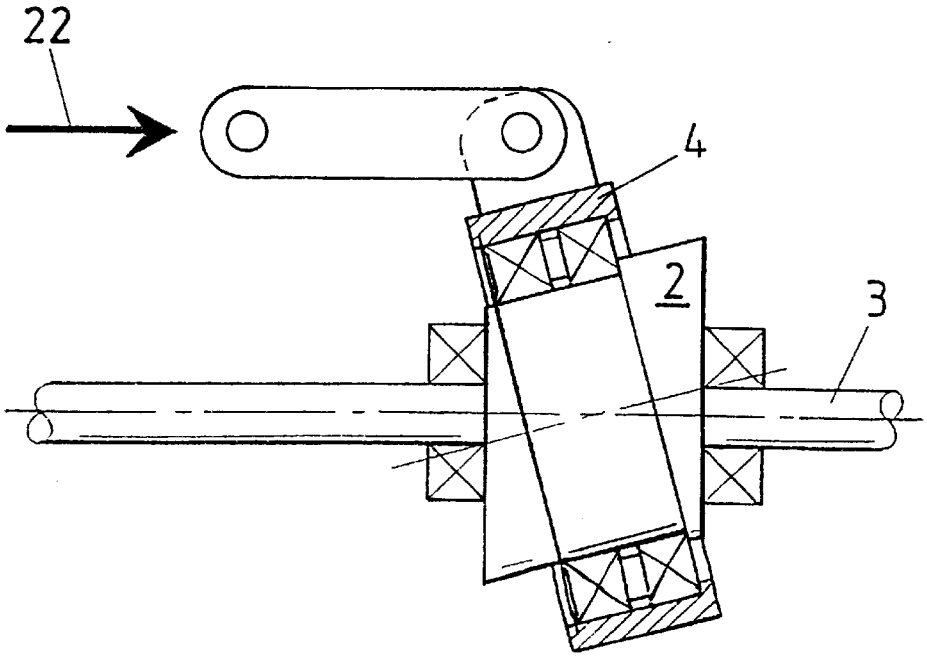

During operation of the engine the explosive energy in the cylinder 19 causes the piston 7 to push the conrod 8 against the offset mount 6. In prior known wobble plate engines the mount is not offset so the conrod is pushing on an axis parallel to the drive shaft. This is shown clearly in FIG. 3*a* and FIG. 3*b* which show a plan and side view of the operative elements of a wobble plate engine assembly incorporating an in-line mount. A vector diagram of forces would show that the engine can not start if the firing piston is at top dead centre because the firing piston is pushing directly against the wobble plate as depicted by arrow 22 in FIGS. 3*a* and 3*b*. If the engine is already running the "dead" spot is momentary and the piston pushes against the "down hill run" of the rotating wobble plate. Nonetheless, the prior art engines suffer reduced efficiency due to this problem.

Figure 4A:
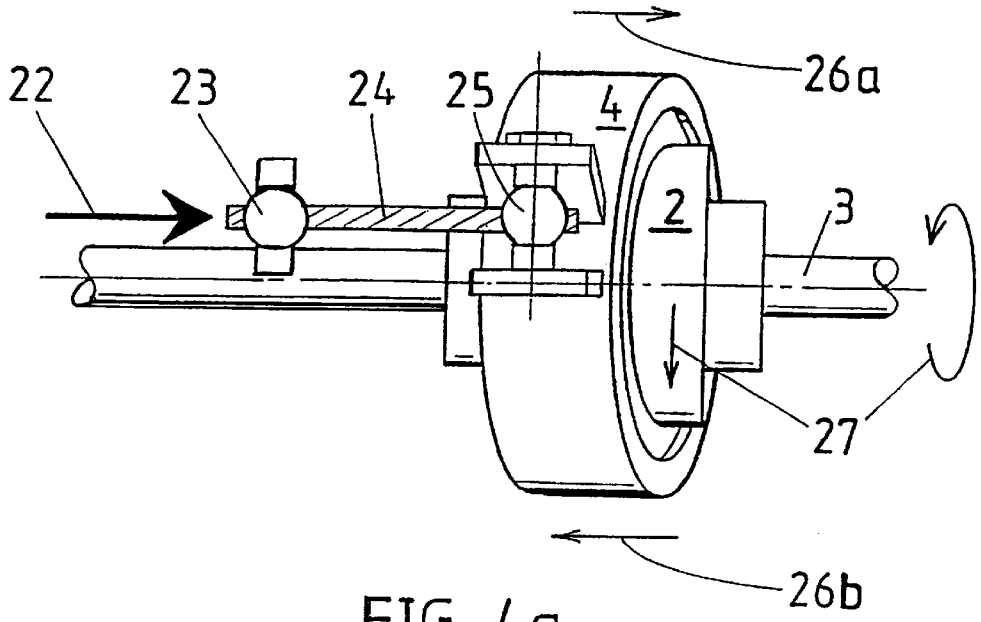
FIG. 4 depicts a wobble plate engine assembly according to the present invention.
Figure 4B:
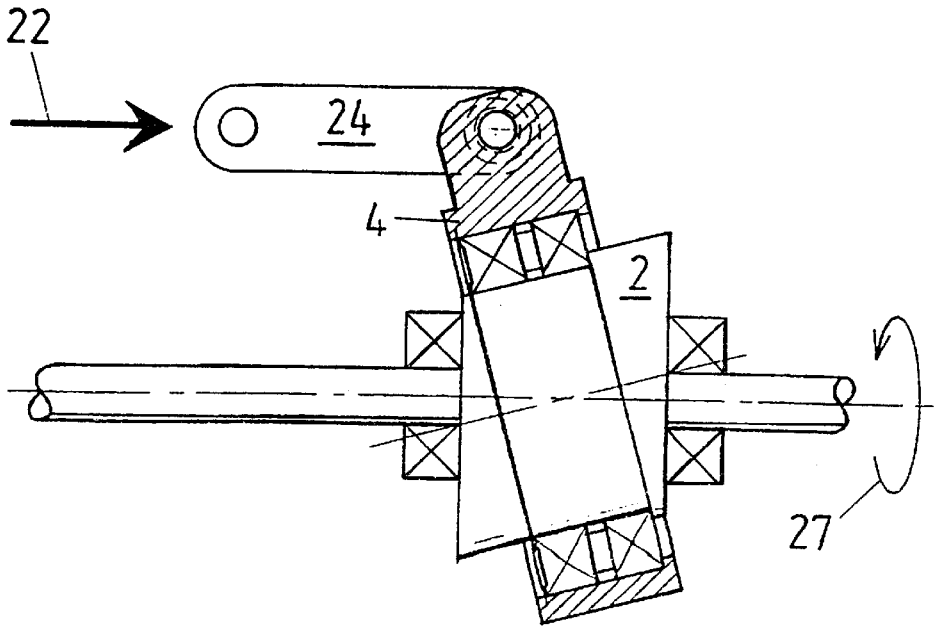

The operative elements of a wobble plate engine assembly according to the present invention are depicted in FIGS. 4*a* and 4*b*. The spherical bearing 23 connecting the piston (not shown) to the conrod 24 and the spherical bearing 25 connecting the conrod 24 to the wobble plate 4 allow twist and rotation of the conrod. Because the conrod 24 is pushing at an offset position and is able to twist and rotate, energy applied in direction of arrow 22 is resolved into centripetal and tangential components. These forces cause the wobble plate to nod as shown by arrows 26*a* and 26*b* in FIG. 4*a*. This motion is translated by the wobble plate into rotation of the wobble hub and drive shaft in direction of arrow 27.

The twist and rotation of the conrod minimises sheer and compressive forces and maximises energy transfer to the wobble plate 4. The effect is that the engine 1 is able to start without a starter motor. Furthermore, a flywheel is not required for operation of the engine. It will be appreciated that the present invention substantially overcomes the problems of the assembly depicted in FIG. 3*a* and FIG. 3*b*.

Figure 5:
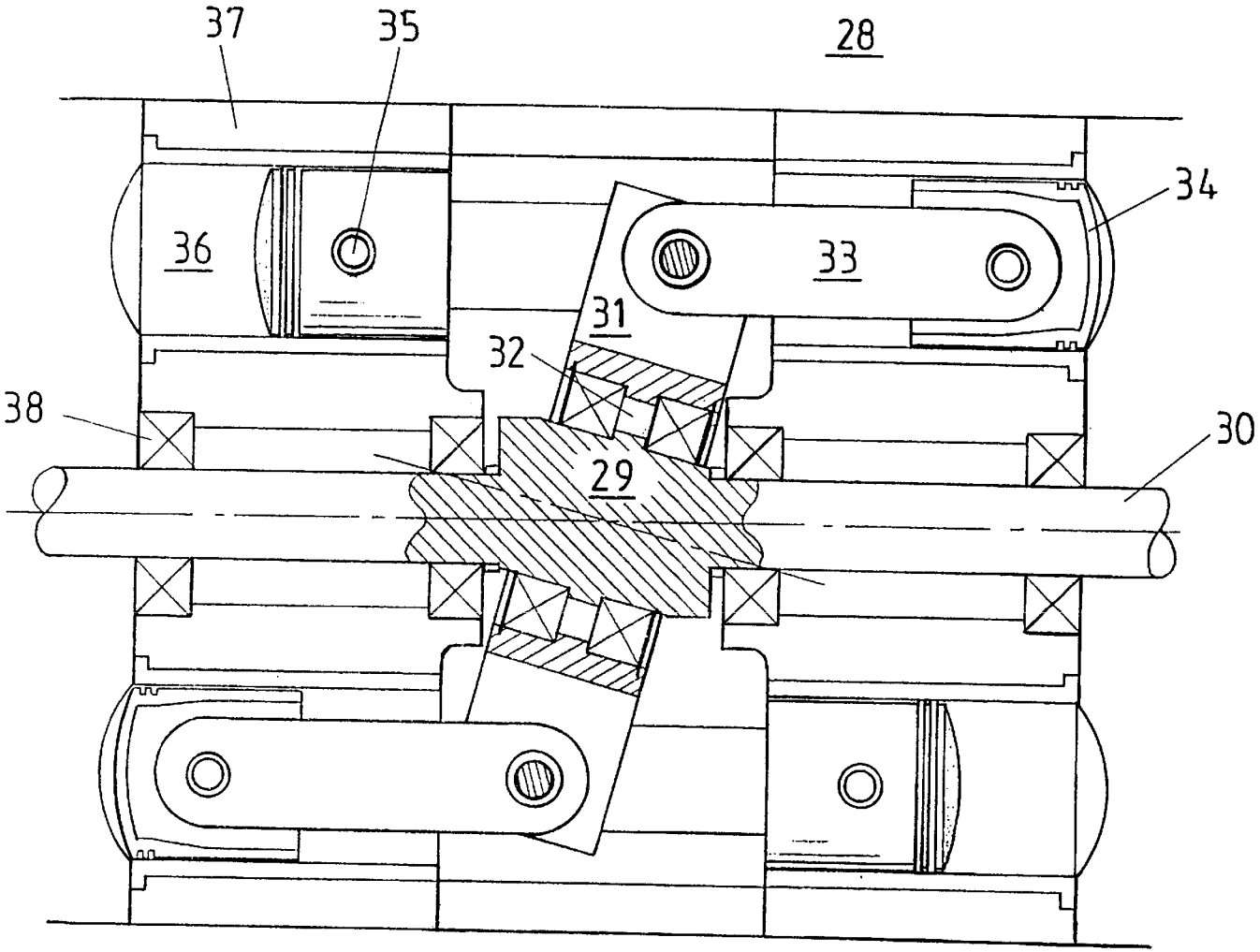
FIG. 5 is a cross-sectional view of a four cylinder wobble plate engine.

A cross-sectional view of a four cylinder embodiment of the invention is shown in FIG. 5. As with the six cylinder embodiment the four cylinder engine 28 comprises a wobble hub 29 formed as part of a drive shaft 30. A wobble plate 31 is rotationally mounted to wobble hub 29 by bearing 32. Conrods, such as 33, link the wobble plate 31 with each of a plurality of pistons 34. The connection between the conrod 33 and the piston 34 is with a gudgeon pin 35 incorporating a spherical bearing as previously described. The pistons 34 reciprocate in cylinders, such as 36, formed in cylinder block 37. The drive shaft 30 is supported in the cylinder block 37 by thrust bearings, such as 38.

Figure 6:
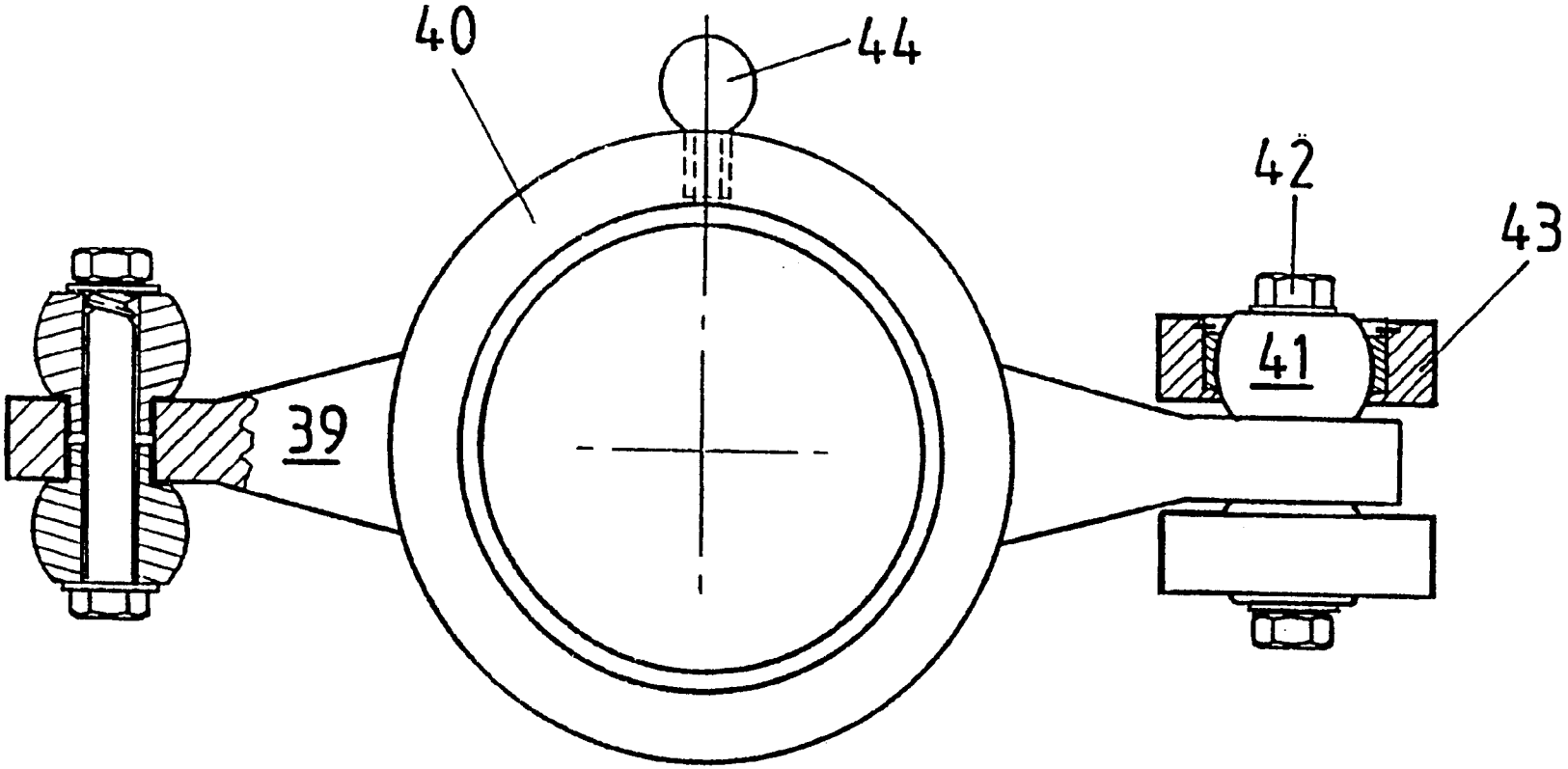
FIG. 6 is an alternative big end assembly.

An offset mount as previously described may be used to connect the conrod 33 to the wobble plate 31. Alternatively, the cantilever arrangement of FIG. 6 may be used. In the alternative arrangement the offset mount is replaced by a single lug 39 extending from the wobble plate 40. Spherical bearings, such as 41 are connected to the lug 39 by suitable means. In the embodiment shown the connection is by double ended bolt 42. As with the previously described embodiment the conrods, such as 43, are able to twist and rotate on the spherical bearing 41 thereby minimising sheer and compressive forces.

The range of oscillation of the wobble plate 4 is seen most clearly in FIG. 3. The inventors have found that this oscillation is most suitably approximately 15 degrees, that is, 7.5 degrees either side of centre.

Figure 7:
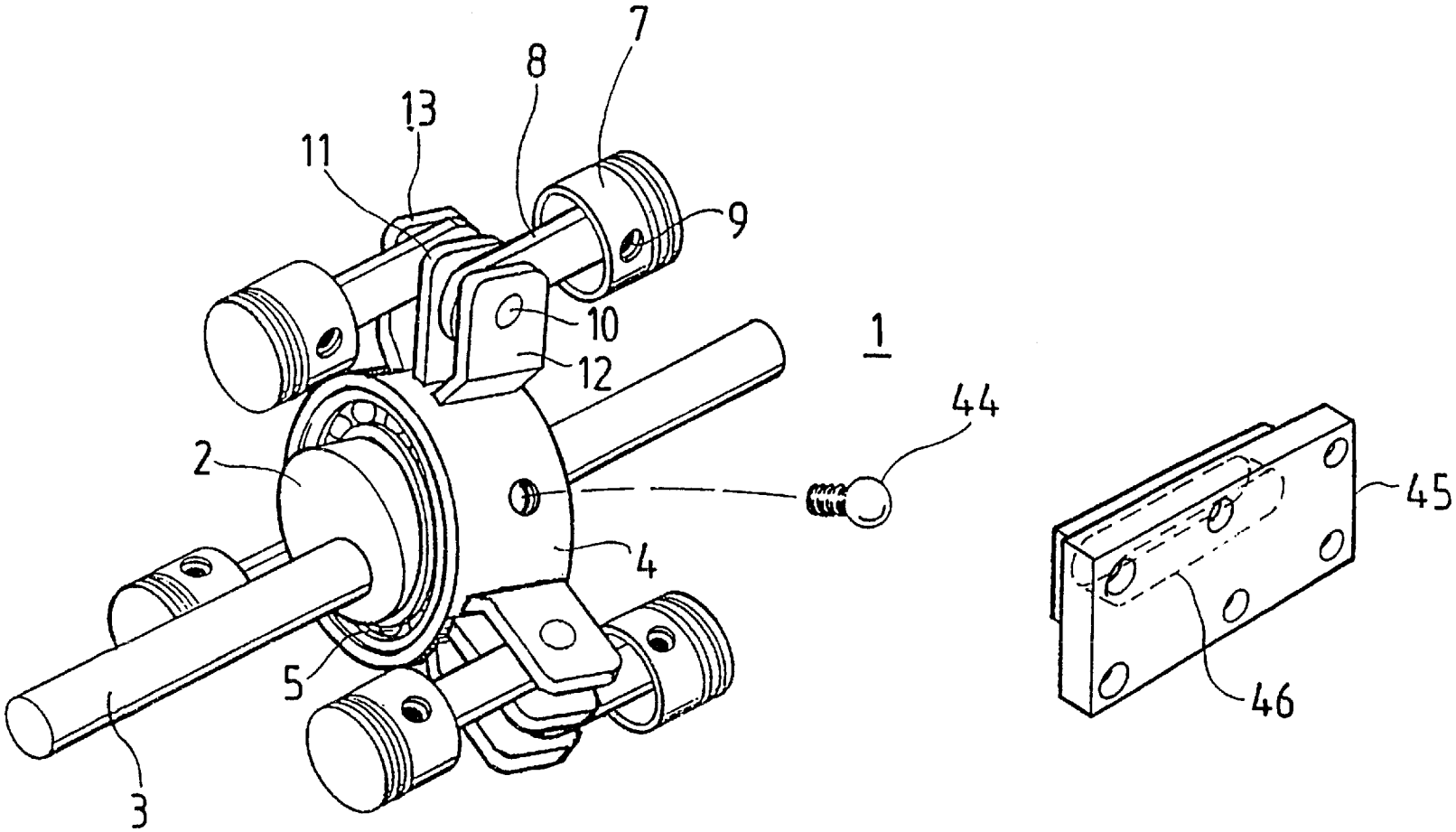
FIG. 7 shows a wobble plate engine assembly with stabiliser plug.

Rotation of the wobble plate is prevented by a ball and track stabiliser shown in FIG. 7. A ball 44 is fixed to the wobble plate 4. A stabiliser plug 45, including a track 46, mounts in the cylinder block (not shown). As the wobble plate 4 moves, the ball 44 runs in track 46 thereby stabilising the motion of the wobble plate 4.

It will be appreciated that the double ended engines described herein have the advantage of being in balance since opposite acting pistons are fired simultaneously. Single ended engines can be built that incorporate the offset mounts and therefore have the operating advantages of the embodiments detailed but will not have the balance advantage.

The engines described herein can be built as two stroke or four stroke engines.

Throughout the specification the aim has been to describe the preferred embodiments of the invention without limiting the invention to any one embodiment or specific collection of features.

We claim:

1. A wobble plate engine assembly comprising:

a drive shaft rotatably mounted in a cylinder block;

one or more pistons mounted for reciprocating movement in a respective cylinder in the cylinder block, an axis of reciprocation of the pistons being substantially parallel to a longitudinal axis of the drive shaft;

a wobble hub associated with the drive shaft for rotation therewith;

a wobble plate rotatably mounted on the wobble hub such that the wobble plate remains rotationally stationary while the drive shaft and wobble hub rotate; and a connecting rod associated with each piston, said connecting rod connecting said piston to a respective offset mount on the wobble plate such that a line of action of the connecting rod at the wobble plate is at all times resolvable into a centripetal and a tangential component.

2. The wobble plate engine assembly of claim 1 wherein the line of action of the connecting rod at the offset mount is offset tangentially from a diameter through the wobble plate.

3. The wobble plate engine assembly of claim 1 wherein each the respective offset mount is offset from an extension of a diameter of the wobble plate along a line parallel to a tangent to an outside circumference of the wobble plate.

4. The wobble plate engine assembly of claim 1 wherein each the respective offset mount comprises a first upstanding lug formed on an extension of a diameter of the wobble plate and a second upstanding lug formed parallel to the first upstanding lug but displaced from the first upstanding lug along a line tangential to an outside diameter of the wobble plate.

5. The wobble plate engine assembly of claim 1 wherein the connection between the connecting rods and the offset mounts incorporate spherical bearings permitting twist and rotation of the connecting rods.

6. The wobble plate engine assembly of claim 1 wherein the connection between the connecting rods and pistons incorporate spherical bearings permitting twist and rotation of the connecting rods.

7. The wobble plate engine assembly of claim 1 wherein the offset mount comprises a single lug with a spherical bearing attached on opposite sides thereof in cantilever fashion.

8. The wobble plate engine assembly of claim 1 wherein pistons connected to the same offset mount are oppositely acting.

9. The wobble plate engine assembly of claim 1 comprising a plurality of pistons and respective cylinders with at least some of the pistons having a line of action of opposite direction to other of the pistons, thereby maintaining balance.

10. The wobble plate engine assembly of claim 9 comprising at least four pistons and four respective cylinders wherein two of the pistons have a line of action of opposite direction to the other two pistons thereby maintaining balance.

11. The wobble plate engine assembly of claim 1 wherein the wobble hub is formed separate from the drive shaft but keyed to the drive shaft so as to rotate with the drive shaft.

12. The wobble plate engine assembly of claim 1 wherein the wobble plate is rotatably mounted on the wobble hub by a wobble bearing.

13. The wobble plate engine assembly of claim 12 wherein the wobble bearing is a thrust or roller bearing.

14. The wobble plate engine assembly of claim 1 further comprising a locating ball associated with the wobble plate and a corresponding track associated with the cylinder block such that motion of the wobble plate is stabilised by the ball being constrained to move in the track.

15. The wobble plate engine assembly of claim 14 wherein the track is formed in a stabiliser plug insertable in the cylinder block.

16. An internal combustion engine incorporating a wobble plate engine assembly comprising:

a drive shaft rotatably mounted in a cylinder block;

one or more pistons mounted for reciprocating movement in a respective cylinder in the cylinder block, an axis of reciprocation of the pistons being substantially parallel to a longitudinal axis of the drive shaft;

a wobble hub assembly associated with the drive shaft for rotation therewith;

a wobble plate rotatably mounted on the wobble hub such that the wobble plate remains rotationally stationary while the drive shaft and wobble hub rotate;

a connecting rod associated with each piston, said connecting rod connecting said piston to a respective offset mount on the wobble plate such that a line of action of the connecting rod at the wobble plate is at all times resolvable into a centripetal and a tengential component; and one or more cylinder heads incorporating a valve assembly.

17. A wobble plate engine assembly comprising:

a drive shaft rotatably mounted in a cylinder block;

at least one piston mounted for reciprocating movement in a respective cylinder in the cylinder block, an axis of reciprocation of the pistons being substantially parallel to a longitudinal axis of the drive shaft;

a wobble hub associated with the drive shaft for rotation therewith;

a wobble plate rotatably mounted on the wobble hub such that the wobble plate remains rotationally stationary while the drive shaft and wobble hub rotate; and a connecting rod associated with each piston; and a plurality of offset mounts formed on an outer perimeter of the wobble plate, each offset mount being displaced laterally from an extension of a diameter of said wobble plate, the connecting rod connecting the piston to a respective offset mount on the wobble plate such that a line of action of the connecting rod at the wobble plate is at all times resolvable into a centripetal and a tangential component.

* * * * *

UNITED STATES PATENT AND TRADEMARK OFFICE

CERTIFICATE OF CORRECTION

PATENT NO. : 6,003,480 
DATED : December 21, 1999
INVENTOR(S) : Noel Quayle and Cornelis Koppenol It is certified that error appears in the above-identified patent and that said Letters Patent is hereby corrected as shown below:

Title page,
Item [57], ABSTRACT,
Line 1, after "incorporating", delete "as" and insert therefor -- an --
Line 6, before "directed", delete "forced" and insert therefor -- force --
Line 7, after "force" (first occurrence), delete "the force"

Column 1,
Line 13, after "or", delete "smash" and insert therefor -- swash --
Line 21, after "Ltd", delete "where" and insert therefor -- were --

Column 3,
Line 2, before "plug", delete "stabiliser" and insert therefor -- stabilizer --

Column 5,
Line 4, after "piston", delete "said" and insert therefor -- the --
Line 5, after "connecting", delete "said" and insert therefor -- the --
Line 7, after "is", delete "at all times"
Lines 15 and 19, after "each", insert -- of --

Signed and Sealed this

Sixteenth Day of July, 2002

*Attest:*

*Attesting Officer*

JAMES E. ROGAN
*Director of the United States Patent and Trademark Office*